US008419355B2

(12) United States Patent
Guemmer et al.

(10) Patent No.: US 8,419,355 B2
(45) Date of Patent: Apr. 16, 2013

(54) FLUID FLOW MACHINE FEATURING AN ANNULUS DUCT WALL RECESS

(75) Inventors: Volker Guemmer, Mahlow (DE); Marius Swoboda, Stahndorf (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 685 days.

(21) Appl. No.: 12/222,532

(22) Filed: Aug. 11, 2008

(65) Prior Publication Data

US 2009/0041576 A1 Feb. 12, 2009

(30) Foreign Application Priority Data

Aug. 10, 2007 (DE) ..... 10 2007 037 924

(51) Int. Cl.
*F04D 27/00* (2006.01)
*F04D 29/46* (2006.01)
*F03B 3/18* (2006.01)

(52) U.S. Cl.
USPC ..... 415/173.1; 415/170.1; 415/914

(58) Field of Classification Search ..... 415/173.1
See application file for complete search history.

(56) References Cited

U.S. PATENT DOCUMENTS 2,933,238 A 4/1960 Stalker
3,066,912 A 12/1962 Scheper
3,572,960 A 3/1971 McBride
3,694,102 A 9/1972 Conrad
3,846,038 A 11/1974 Carriere et al.
3,849,023 A 11/1974 Klompas
3,993,414 A 11/1976 Meauze et al.
4,155,680 A 5/1979 Linko et al.
4,415,310 A 11/1983 Bouiller et al.
4,466,772 A * 8/1984 Okapuu et al. ..... 415/173.5
4,479,755 A 10/1984 Skoe
(Continued)

FOREIGN PATENT DOCUMENTS

DE 889506 9/1953
DE 1042828 11/1958
(Continued)

OTHER PUBLICATIONS

Yang, Zhou. "Boundary Layer Separation Control on a Highly-loaded, Low-solidity Compressor Cascade." Journal of Thermal Science 19.2 (2010): 97-104.*

(Continued)

*Primary Examiner* — Thomas L Dickey
*Assistant Examiner* — Joseph Schoenholtz
(74) *Attorney, Agent, or Firm* — Timothy J. Klima; Shuttleworth & Ingersoll, PLC

(57) ABSTRACT

A fluid flow machine has a flow path provided by a casing (1) and a rotating shaft (2), in which rows of rotor blades (3) and stator blades (4) are arranged, and includes at least one annular groove-type recess (5) being disposed in a blade (3, 4) tip area in an annulus duct wall of the casing (1) and/or the shaft (2). An upstream end point (E) of the recess (5) in a flow direction is set at a distance (e)>0 forward of a forward blade tip point (A), and a downstream end point (F) of the recess (5) is set at a distance (f) rearward of point (A), where: 0.5 L>(f)>0, and L is a distance between point (A) and a rearward blade tip point (B).

19 Claims, 10 Drawing Sheets

U.S. PATENT DOCUMENTS

Figure 1:
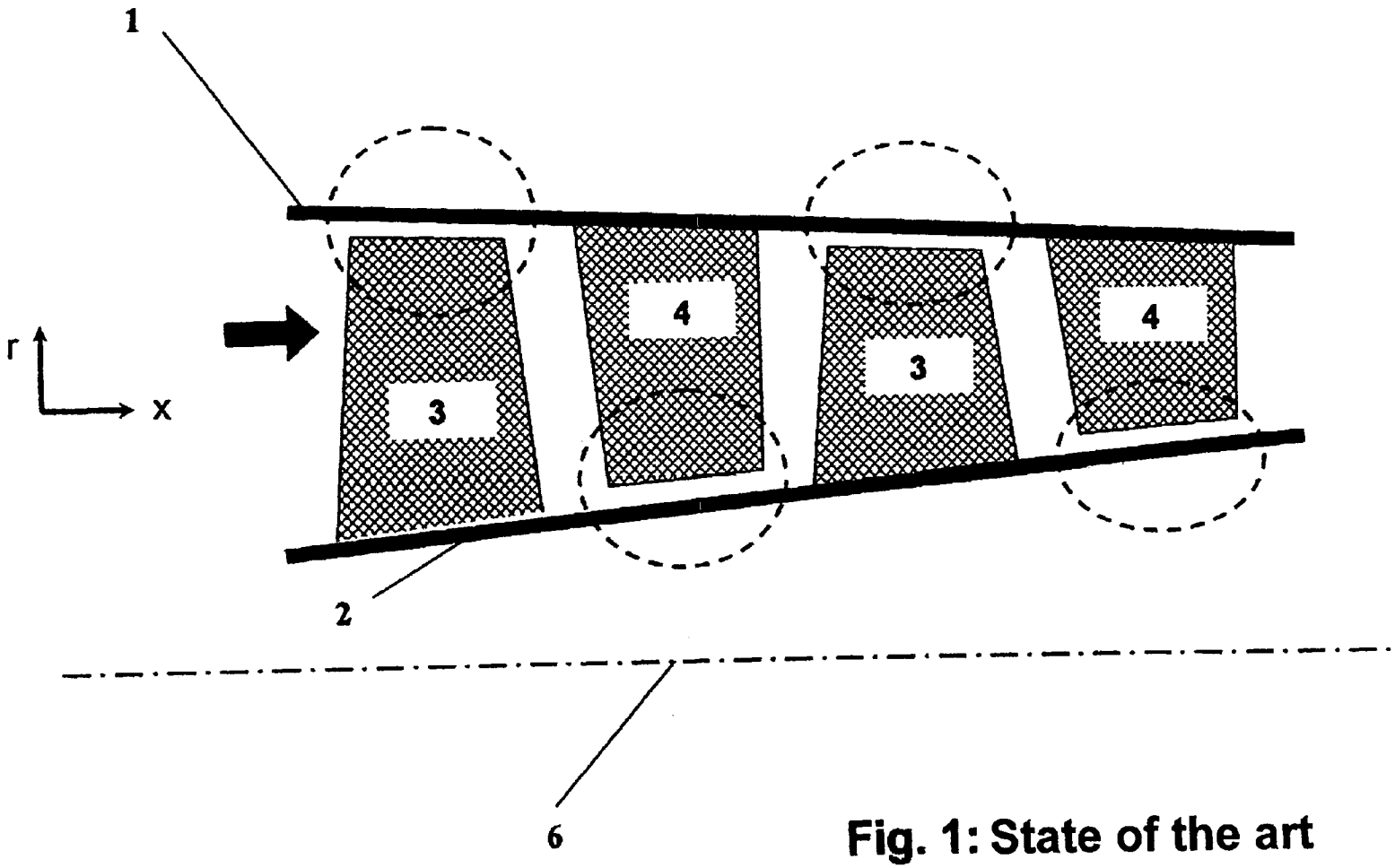

| | | | | |
|---|---|---|---|---|
| 4,642,027 | A | 2/1987 | Popp | |
| 4,659,282 | A | 4/1987 | Popp | |
| 5,059,093 | A * | 10/1991 | Khalid et al. | 415/115 |
| 5,137,419 | A * | 8/1992 | Waterman | 415/170.1 |
| 5,203,162 | A | 4/1993 | Burge | |
| 5,230,605 | A | 7/1993 | Yamaguchi | |
| 5,308,225 | A * | 5/1994 | Koff et al. | 415/57.3 |
| 5,327,716 | A | 7/1994 | Giffin et al. | |
| 5,431,533 | A | 7/1995 | Hobbs | |
| 5,474,417 | A | 12/1995 | Privett et al. | |
| 5,480,284 | A | 1/1996 | Wadia et al. | |
| 5,707,206 | A * | 1/1998 | Goto et al. | 415/173.1 |
| 5,762,034 | A | 6/1998 | Foss | |
| 5,762,470 | A * | 6/1998 | Gelmedov et al. | 415/57.4 |
| 5,876,182 | A | 3/1999 | Schulte | |
| 5,950,308 | A | 9/1999 | Koff et al. | |
| 6,109,868 | A | 8/2000 | Bulman et al. | |
| 6,234,747 | B1 | 5/2001 | Mielke et al. | |
| 6,290,458 | B1 | 9/2001 | Irie et al. | |
| 6,574,965 | B1 | 6/2003 | Feulner | |
| 6,585,479 | B2 | 7/2003 | Torrance | |
| 6,619,909 | B2 | 9/2003 | Barnett et al. | |
| 6,663,346 | B2 | 12/2003 | Munsell et al. | |
| 6,742,983 | B2 | 6/2004 | Schmuecker | |
| 6,832,890 | B2 | 12/2004 | Booth | |
| 7,077,623 | B2 | 7/2006 | Guemmer | |
| 7,097,414 | B2 | 8/2006 | Stangeland | |
| 7,186,072 | B2 | 3/2007 | Seitz | |
| 7,387,487 | B2 * | 6/2008 | Guemmer | 415/115 |
| 7,575,412 | B2 * | 8/2009 | Seitz | 415/58.5 |
| 7,594,793 | B2 * | 9/2009 | Guemmer | 415/144 |
| 7,645,121 | B2 | 1/2010 | Tudor | |
| 7,811,049 | B2 | 10/2010 | Xu | |
| 7,861,823 | B2 | 1/2011 | Prasad et al. | |
| 2003/0026695 | A1 * | 2/2003 | Schmuecker | 415/173.1 |
| 2004/0081552 | A1 | 4/2004 | Guemmer | |
| 2005/0019152 | A1 * | 1/2005 | Seitz | 415/58.5 |
| 2005/0058541 | A1 | 3/2005 | LeBiez et al. | |
| 2005/0226717 | A1 * | 10/2005 | Xu | 415/58.5 |
| 2005/0238483 | A1 * | 10/2005 | Guemmer | 415/169.1 |
| 2006/0051199 | A1 * | 3/2006 | Guemmer | 415/144 |
| 2006/0104805 | A1 | 5/2006 | Guemmer | |
| 2006/0153673 | A1 | 7/2006 | Guemmer | |
| 2008/0044273 | A1 | 2/2008 | Khalid | |
| 2008/0199306 | A1 | 8/2008 | Lebret | |
| 2009/0160135 | A1 | 6/2009 | Turini et al. | |
| 2009/0290974 | A1 | 11/2009 | Bayere et al. | |

FOREIGN PATENT DOCUMENTS

| | | |
|---|---|---|
| DE | 1428188 | 11/1968 |
| DE | 3407945 | 9/1985 |
| DE | 19632207 | 2/1998 |
| DE | 10135003 | 10/2002 |
| DE | 10233032 | 1/2004 |
| DE | 10330084 | 3/2004 |
| DE | 102004043036 | 3/2006 |
| EP | 0497574 | 9/1995 |
| EP | 0718469 | 6/1996 |
| EP | 0754864 | 1/1997 |
| EP | 0719908 | 3/2000 |
| EP | 1013937 | 6/2000 |
| EP | 1286022 | 2/2003 |
| EP | 1382855 | 1/2004 |
| GB | 619722 | 3/1949 |
| GB | 987625 | 3/1965 |
| GB | 2408546 | 6/2005 |
| WO | 9510692 | 4/1995 |

OTHER PUBLICATIONS

Strazisar, A. J., Bright, M. B., Thorp, S., Culley, D.E., Suder, K. L., "Compressor Stall Control Through Endwall Recirculation", ASME GT2004-54295, proceedings of the ASME Turbo Expo 2004, Jun. 14-17, 2005, Vienna, Austria.*

Gao, P., Zhang, Y., Zhang S., "Numerical investigation of the Different Casing Treatment in a Centrifugal Compressor", Proceeding APWCS '10 Proceedings of the 2010 Asia-Pacific Conference on Wearable Computing Systems.*

Moore, R., Effect of Casing Treatment on Overall and Blade-Element Performance of a Compressor Rotor. NASA TN D-6538. Nov. 1971.*

Jian H., Hu, W., "Numerical Investigation of Inlet Distortion on an Axial Flow Compressor Rotor with Circumferential Groove Casing Treatment", Chinese Journal of Aeronautics, 21(2008) 496-505.*

Friedrichs, Jens, Sven Baumgarten, Günter Kosyna, and Udo Stark. "Effect of Stator Design on Stator Boundary Layer Flow in a Highly Loaded Single-Stage Axial-Flow Low-Speed Compressor." Journal of Turbomachinery 123.3 (2001): 483.*

German Search Report dated Jun. 8, 2011 for related German patent application.

German Search Report dated Oct. 14, 2011 from related application.

German Search Report dated Jul. 1, 2011 from related German patent application. [596].

European Search Report dated Nov. 22, 2006 from related patent application [472].

Guemmer—U.S. Appl. No. 11/280,817, filed Nov. 17, 2005.

Guemmer—U.S. Appl. No. 12/534,388, filed Aug. 3, 2009.

* cited by examiner

Fig. 1: State of the art

FLUID FLOW MACHINE FEATURING AN ANNULUS DUCT WALL RECESS

This application claims priority to German Patent Application DE102007037924.4 filed Aug. 10, 2007, the entirety of which is incorporated by reference herein.

The aerodynamic loadability and the efficiency of fluid flow machines such as blowers, compressors, pumps and fans, is limited in particular by the growth and the separation of boundary layers in the rotor and stator blade tip area near the casing or the hub wall, respectively. On blade rows with running gaps, this leads to re-flow phenomena and the occurrence of instability of the machine at higher loads. Fluid flow machines according to the state of the art either have no particular features to provide remedy in this area (see FIG. 1), or so-called casing treatments are used as counter-measures comprising the most varied configurations of chambers and/or angular slots, mostly in the casing above the rotor.

Known solutions are revealed for example in the following documents:

US 2005/0226717 A1 (Flow Control Arrangement)

DE 101 35 003 C1 (Compressor Casing Structure)

DE 103 30 084 A1 (Recirculation Structure for Turbocompressors)

The present invention therefore relates to fluid flow machines, such as blowers, compressors, pumps and fans of the axial, semi-axial and radial type. The working medium or fluid may be gaseous or liquid.

The fluid flow machine according to the present invention may comprise one or several stages, each of which includes a rotor and a stator.

According to the present invention, the rotor includes a number of blades which are connected to the rotating shaft of the fluid flow machine and impart energy to the working medium. The rotor features a free blade end on the casing. The stator in accordance with the present invention includes a number of stationary blades which, on the casing side, have a fixed blade end.

In accordance with the present invention, the fluid flow machine may be provided with a special type of stator upstream of the first rotor, a so-called inlet guide vane assembly.

According to the present invention, at least one stator or inlet guide vane assembly, instead of being fixed, can be variable to change the angle of attack. A spindle accessible from the outside of the annulus can, for example, accomplish such a variation.

The fluid flow machine may, in a special form, be provided with at least one row of variable rotors.

Figure 2:
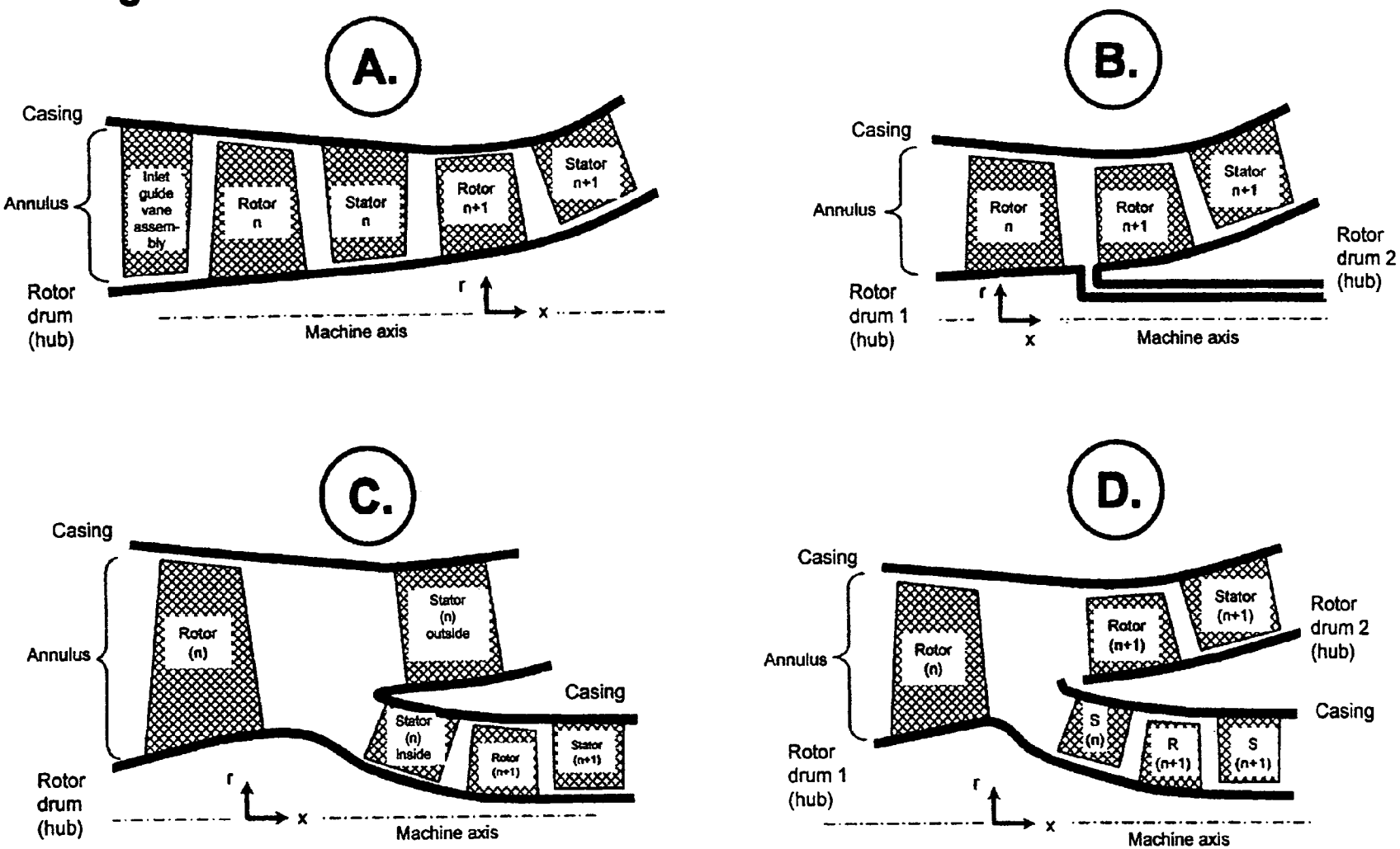

In an alternative configuration, said fluid flow machine may also have a bypass configuration, with the single-flow annulus dividing into two concentric annuli behind a certain blade row, with each of these annuli housing at least one further blade row. FIG. 2 shows examples of fluid flow machines relevant to the present invention.

Simple existing concepts of casing treatments in the form of slots and/or chambers in the annulus duct wall provide for an increase in the stability of the fluid flow machine. However, due to unfavorably selected arrangement and shaping, this increase in stability is unavoidably accompanied by a loss in efficiency.

More particularly, the present invention relates to the shape of a section of the annulus duct wall of a fluid flow machine and the arrangement and shaping of recesses in said annulus duct wall section in the area of a blade row with free end and running gap.

A broad aspect of the present invention is to provide a fluid flow machine of the type specified at the beginning which, while avoiding the disadvantages of the state of the art, is characterized by exerting a highly effective influence on the boundary layer in the blade tip area.

Figure 5A:
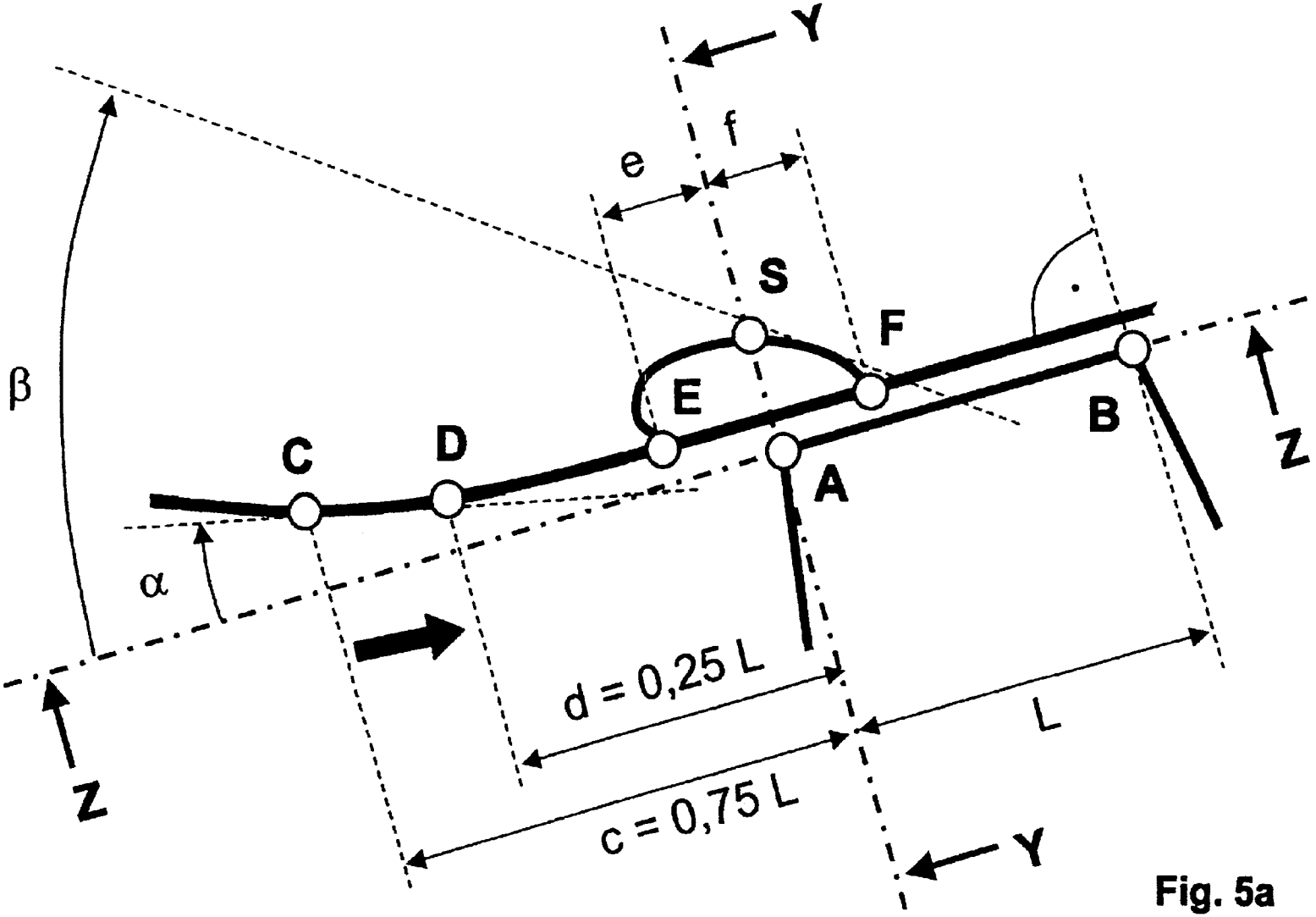
Figure 5B:
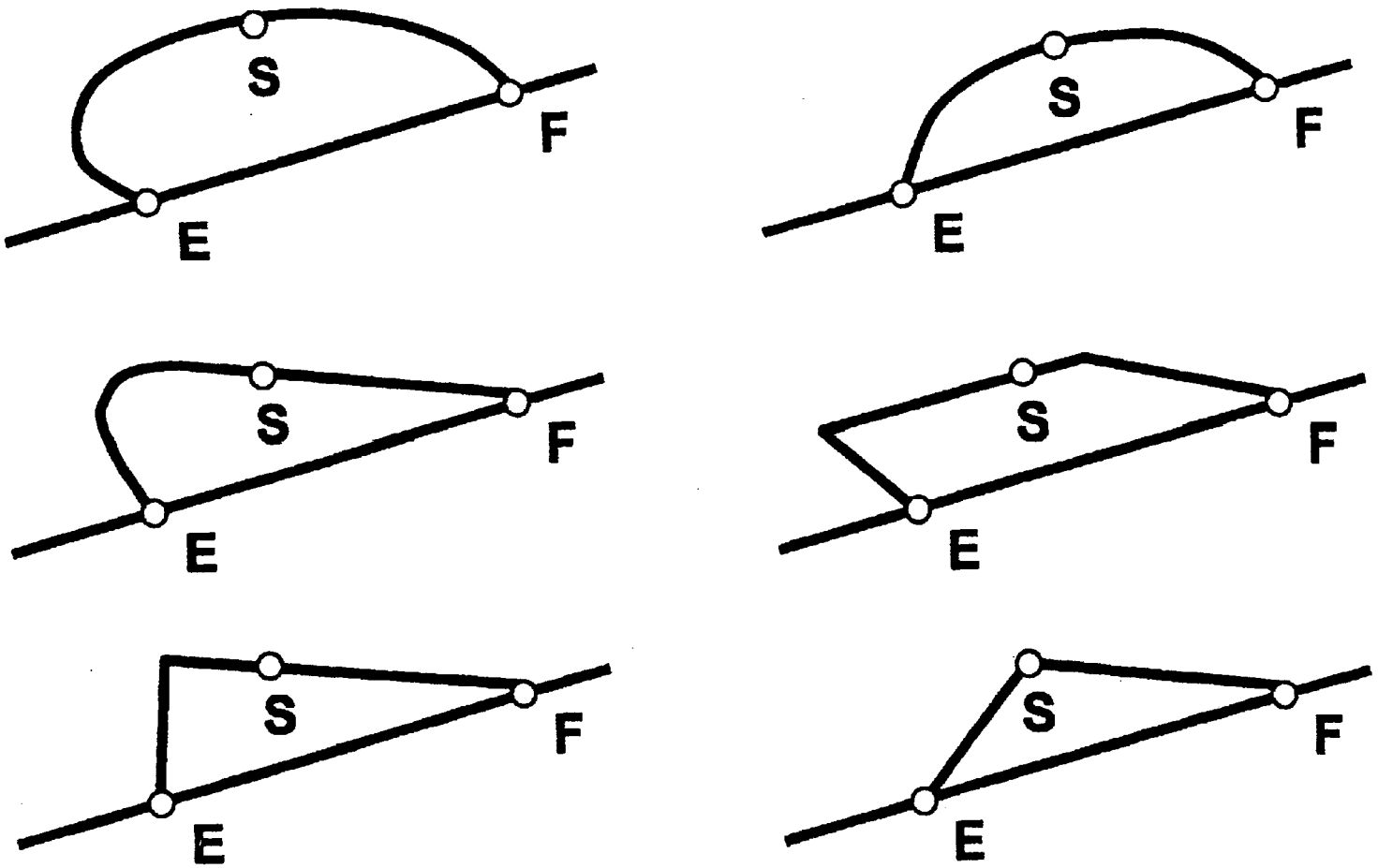
Figure 6:
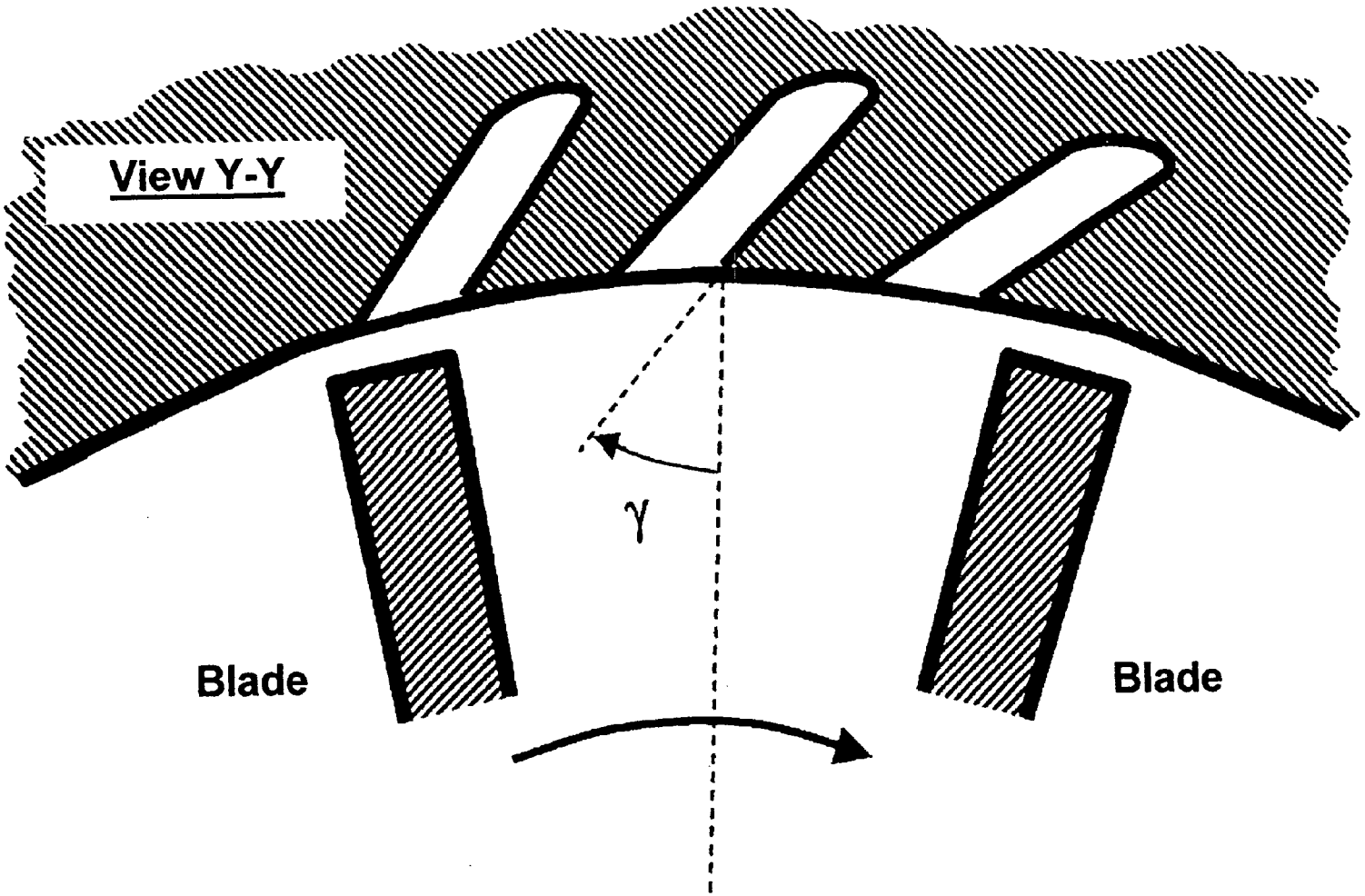
Figure 7A:
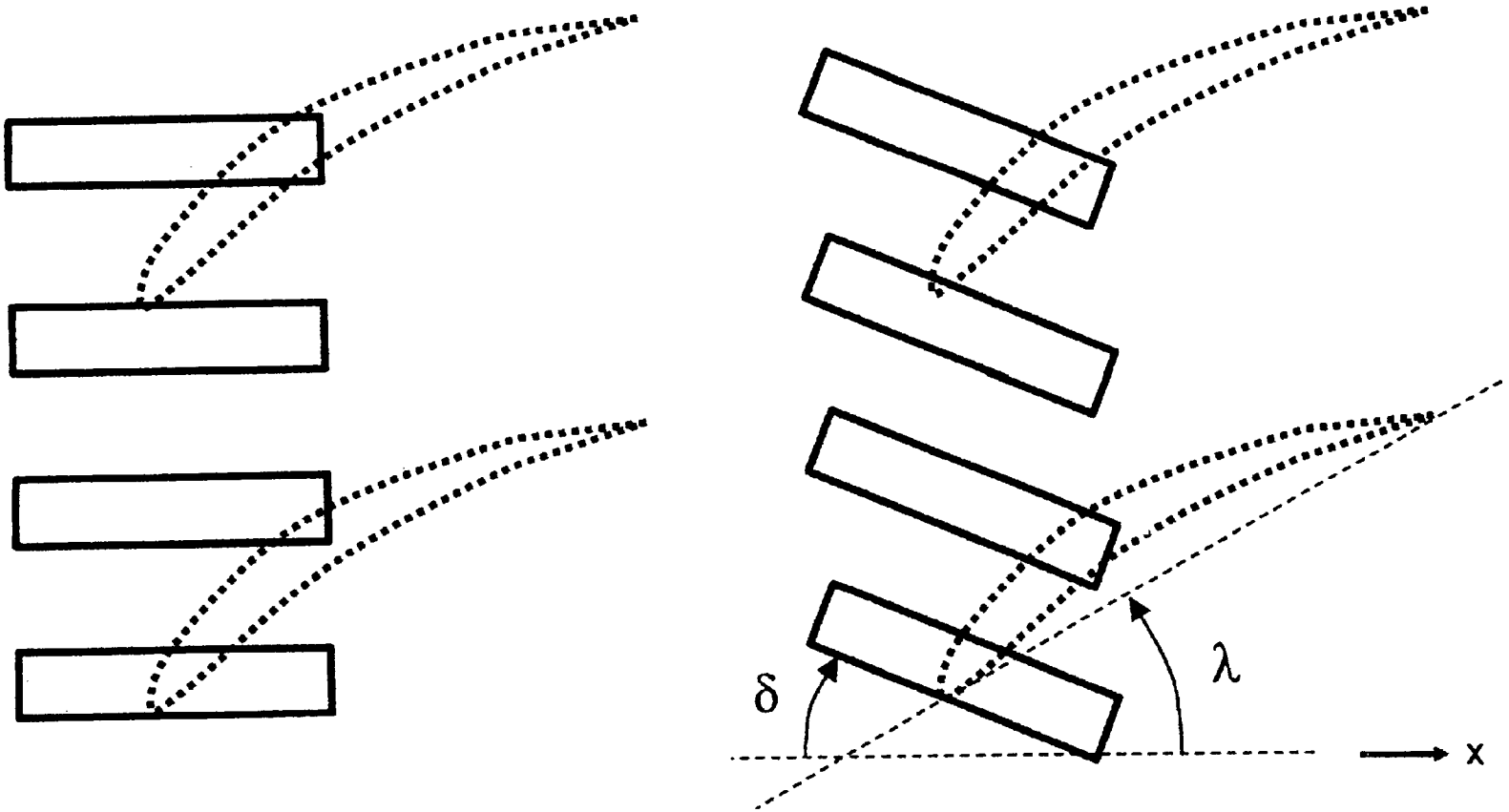
Figure 7B:
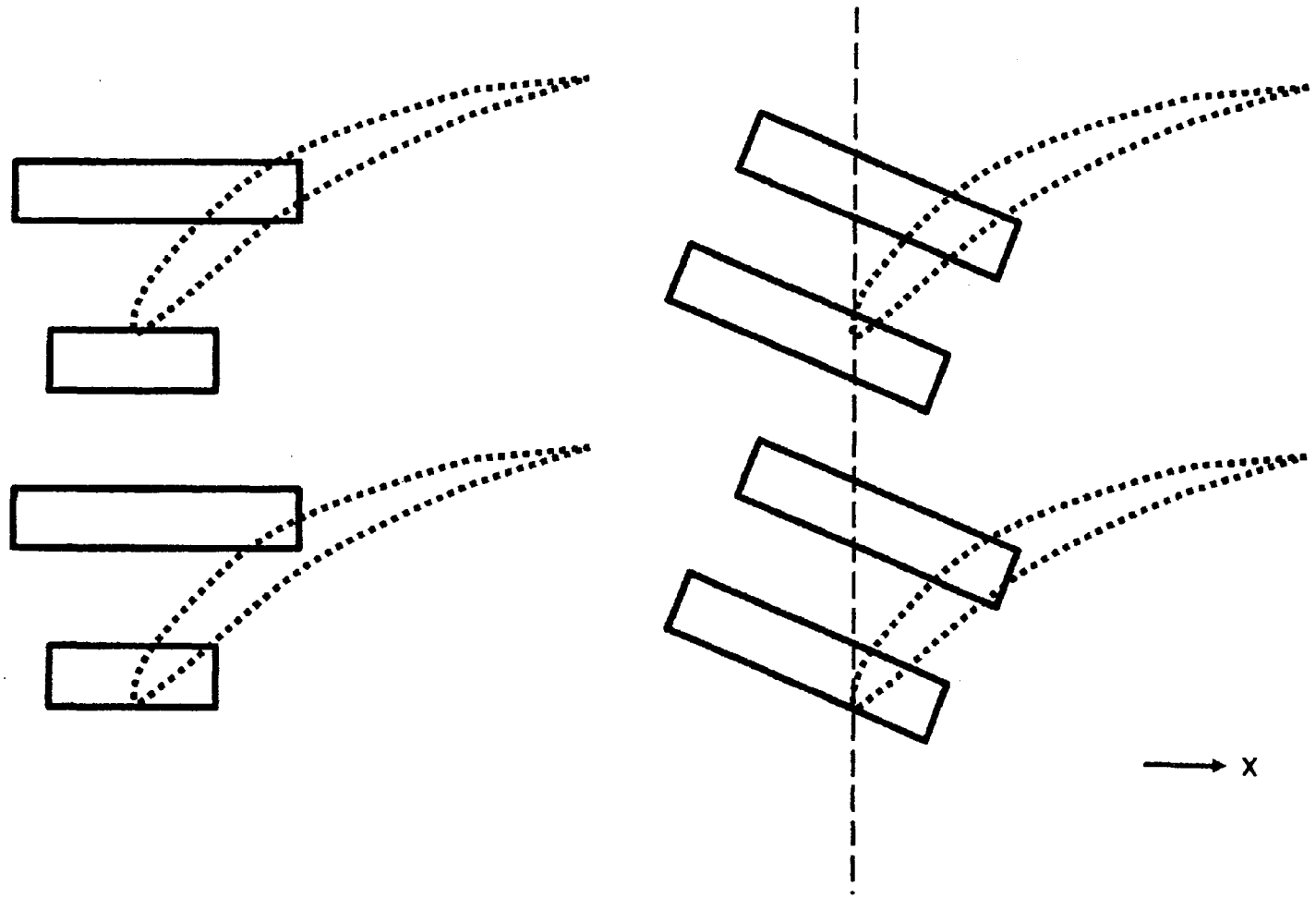
Figure 7C:
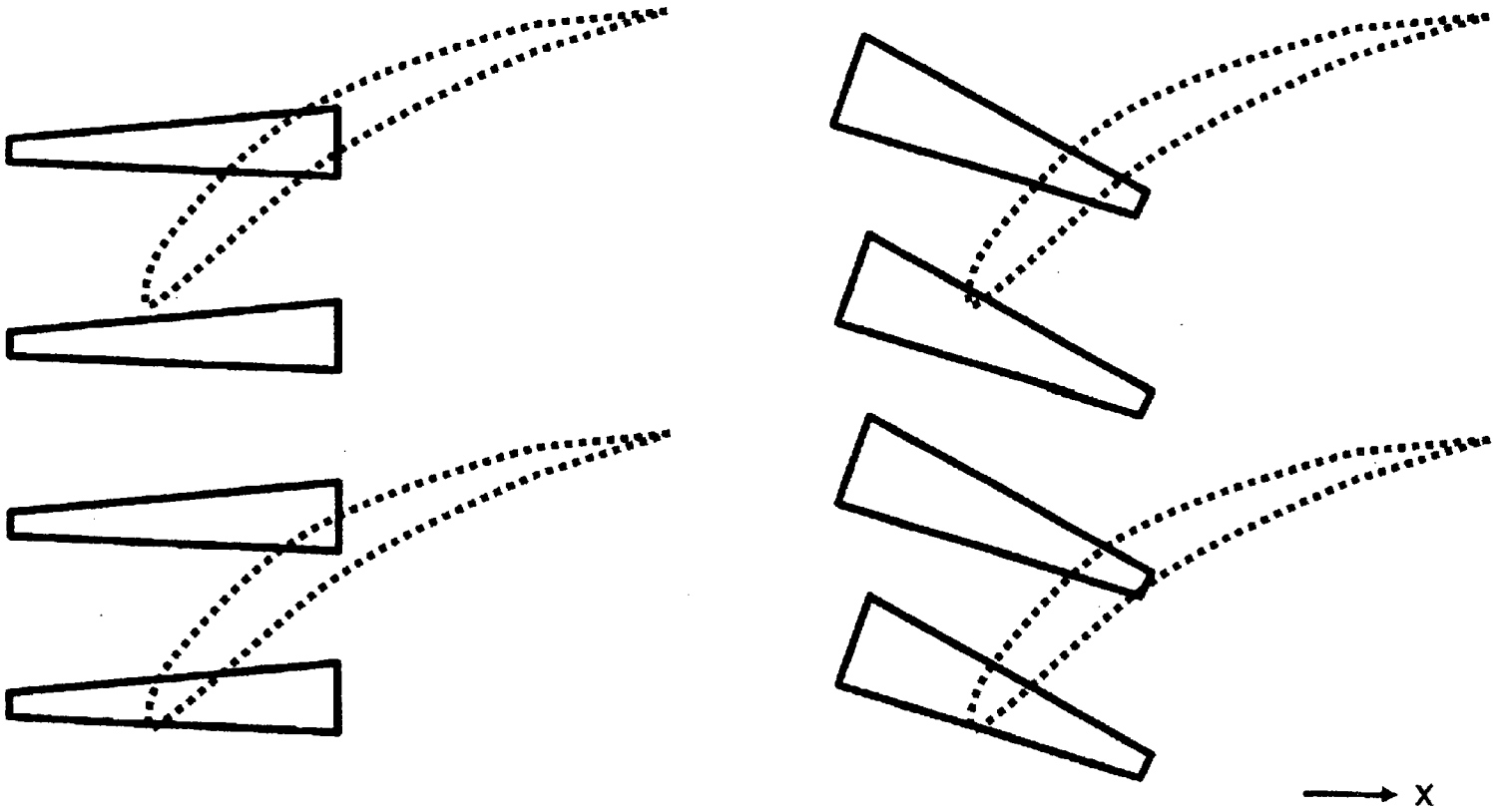

The present invention is more fully described in the light of the accompanying drawings showing preferred embodiments. In the drawings, FIG. 1 is a sketch of the state of the art, FIG. 2 shows examples of fluid flow machines relevant to the present invention, FIG. 3 is a sketch of the solution according to the present invention, FIG. 4 provides a definition of quantities relevant to the present invention, part 1, meridional section, FIG. 5*a* provides a definition of quantities relevant to the present invention, part 2, meridional section, FIG. 5*b* shows possible outline configurations of the annulus duct wall recess in accordance with the present invention, FIG. 6 provides a definition of quantities relevant to the present invention, view Y-Y, FIG. 7*a* shows a view Z-Z, part 1, FIG. 7*b* shows a view Z-Z, part 2, FIG. 7*c* shows a view Z-Z, part 3.

FIG. 1 shows, encircled by broken lines, the zones relevant to the present invention, namely areas of the fluid flow machine with free blade ends with running gap.

Figure 3:
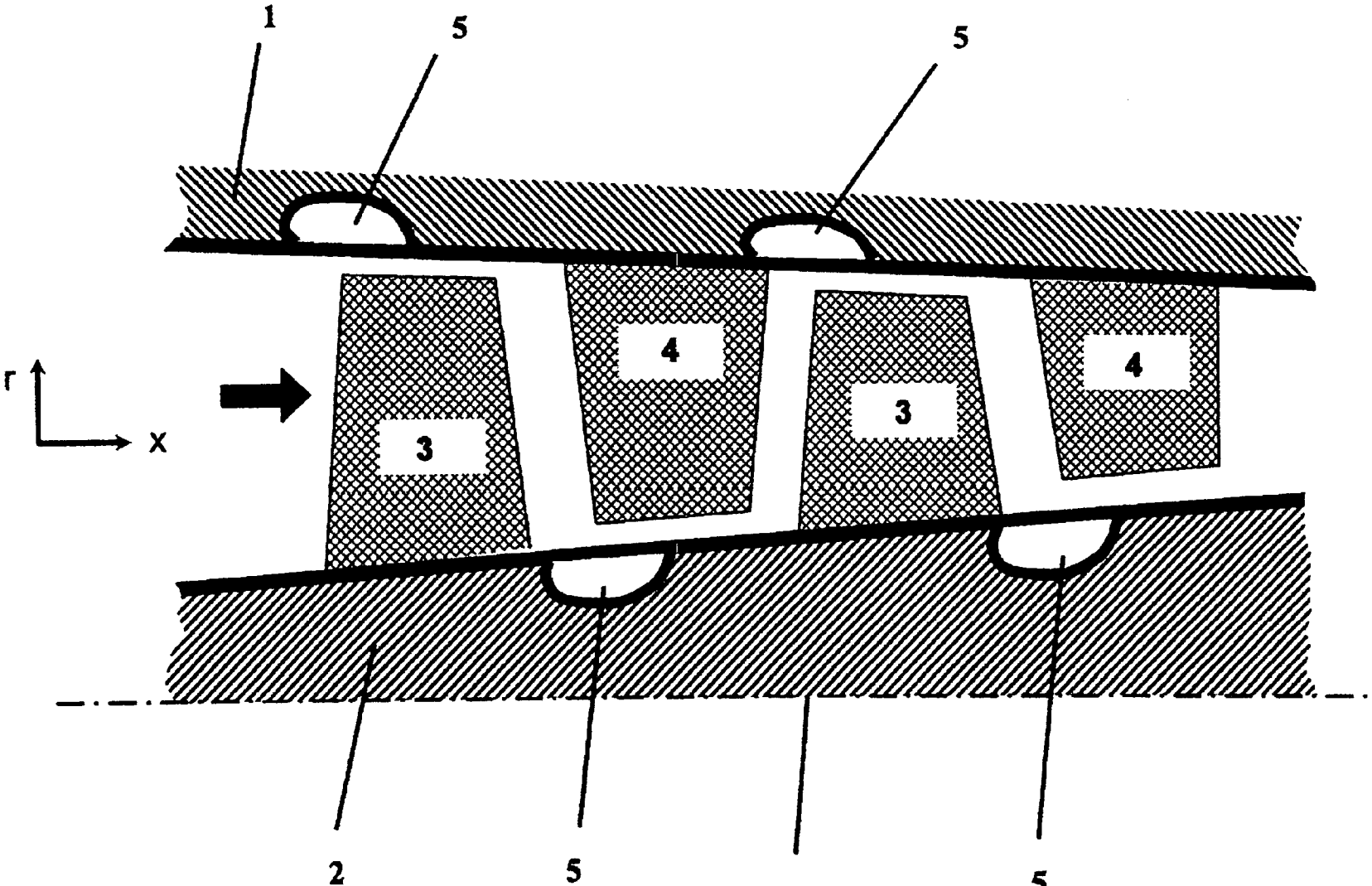

FIG. 3 shows a sketch of the solution according to the present invention with at least one recess 5 characterized by partial overlap with the running path of the respective blade row 3,4. It may be advantageous here for the recess 5, or group of recesses 5, to also partially extend into the bladed area of an optional upstream blade row 3,4.

Figure 4:
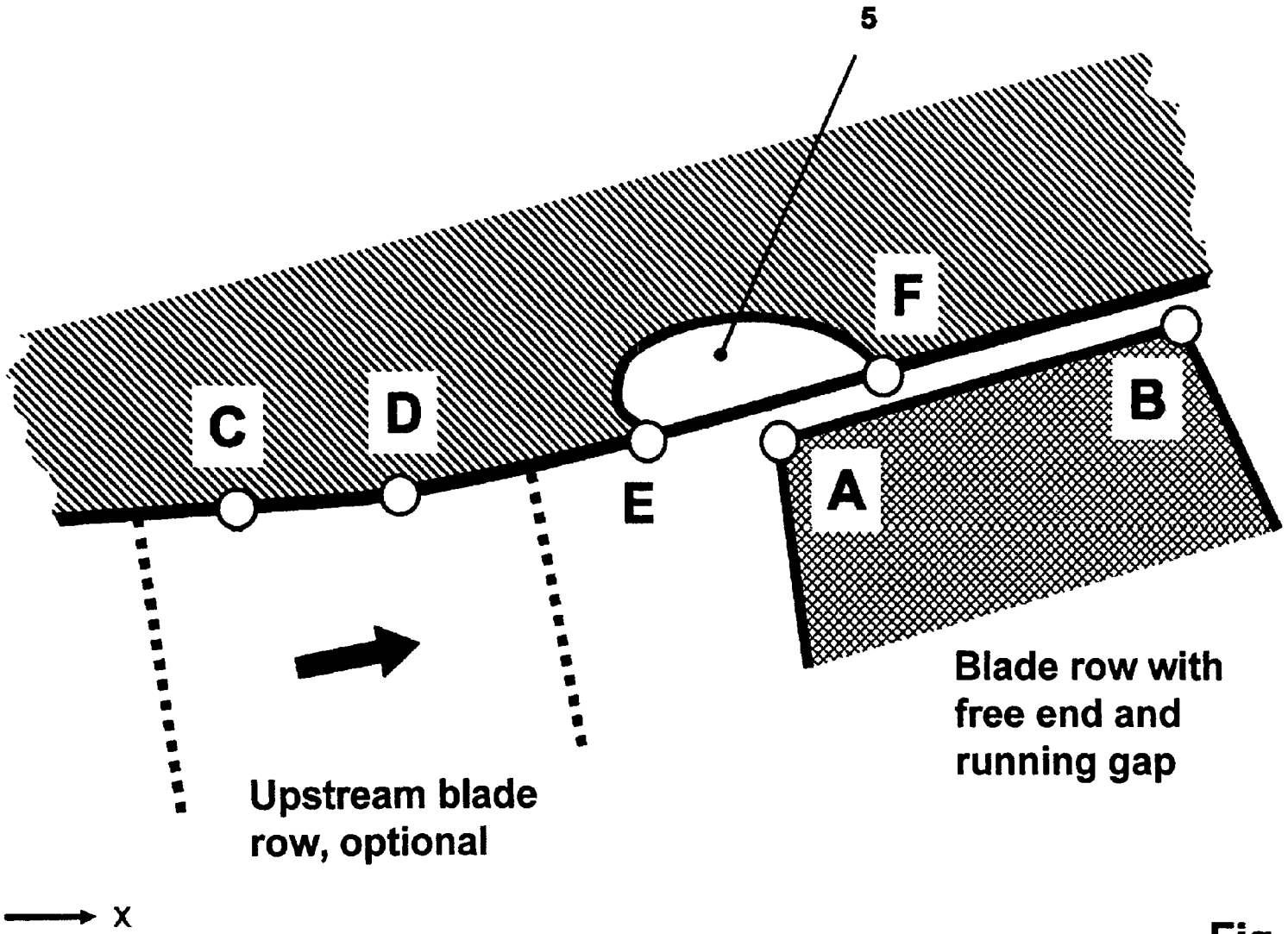

FIG. 4 shows an invention-relevant detail of the fluid flow machine comprising the section of a hub or casing assembly with the annulus duct wall formed therefrom and the blade row disposed in this area. The configuration may either be a combination of a rotor blade 3 row and a casing assembly 1 or the combination of a stator blade 4 row and a hub assembly 2. Also marked are an optional upstream blade row and the outline of the inventive annulus duct wall recess projected into the meridional plane shown. A small arrow indicates the machine axis direction x and a bold arrow shows the main flow direction. Also shown are six characterizing points of the configuration. First of all, these are the blade tip points on the leading and trailing edge, A and B. The forward end and the rearward end of the annulus duct wall recess 5 on the main flow path are indicated by the points E and F. In addition, two further auxiliary points, C and D, are shown upstream of the respective blade row to characterize the contour of the annulus duct wall.

FIG. 5*a* shows a reduced representation of the features of FIG. 4, however with further points and geometrical data (not to scale). Defined between the blade tip points A and B is the reference chord length L. All distances indicated are measured in the meridional plane shown (plane established by axial direction x and radial direction r) parallel to the contour of the blade tip, i.e. parallel to the connecting line A-B.

The auxiliary point D lies upstream of A at a distance d=0.25 L.

The auxiliary point C lies upstream of A at a distance c=0.75 L. A straight line through the auxiliary points C and D intersecting a straight line through the blade tip points A and B produces an angle alpha.

In accordance with the present invention, angle alpha is between −15° and 30° in the direction convention shown.

In accordance with the present invention, the forward end point of the annulus duct wall recess E lies before the leading edge point A at a distance e>0. In particular cases, point E may also lie upstream of point D and/or in the bladed area of another blade row optionally disposed upstream of the blade row considered.

In accordance with the present invention, the rearward end point of the annulus duct wall recess F lies behind the leading edge point A at a distance f, with 0.5 L>f>0.

The orthogonal on line A-B through point A establishes point S as an intersection with the projected outline of the annulus duct wall recess 5.

In accordance with the present invention, angle beta, which is positive in the direction shown and is established between the straight line through the blade tip points A and B and a tangent to the outline of the annulus duct wall recess 5, amounts to min. 15° and max. 70° at at least one point of the outline of the recess 5 provided in the meridional section between S and F. Thus, it is ensured that the fluid forced from the blade in the overlapping area (area between points S and B) into the recess 5 is effectively carried in upstream direction to a place before the blade row.

In a particularly favorable embodiment of the annulus duct wall recess the angle beta is between 15° and 40° at at least one point of the outline of the recess 5 provided in the meridional section between E and S. This provides for a particularly smooth re-entrance of the fluid into the main flow path upstream of the blade row.

FIG. 5*b* shows a variety of possible outline configurations of the annulus duct wall recess 5 according to the present invention, with the outline featuring a completely curved or also a straight form. In particular, the triangularity shown at the bottom left and right in FIG. 5*b* is considered as an easily producible shape for the recess.

FIG. 6 shows the view Y-Y as designated in FIG. 5*a*. While a combination of rotor blade row and casing is here shown, the following statements apply similarly to the analogically representable combination of stator blade row and hub.

The Figure shows two blade tips in the environment of a section of the casing wall 1. The annulus duct wall (here typically a casing) is provided with a number of circumferentially distributed recesses 5. In a particularly favorable solution according to the present invention, the recesses, other than shown in FIG. 6, are differently spaced relative to each other in circumferential direction. The recesses are shown approximately at their position of maximum penetration into the annulus duct wall. According to the present invention, the recesses 5 have an inclination angle gamma against the radial direction of the machine. The inclination of the recesses according to the present invention is 25°<gamma<75° and is accordingly oriented in the running direction of the blades moving relatively to them. The amount of penetration and the shape selected for the bottom of the recess are of secondary importance for the present invention and are, therefore, freely selectable.

FIGS. 7*a* to 7*c* show, each in view Z-Z, a development of the circumference of the fluid flow machine in the area of the annulus duct wall recess 5. The dotted lines indicate two blades of the respective blade row at which the recess is disposed. Illustrated are the openings of an arrangement of recesses on the annulus duct wall in partial overlap with the blade row. In accordance with the present invention, the openings in flow direction are of slender nature, i.e. the extension in circumferential direction is smaller than the extension vertical to it.

FIG. 7*a* shows the orientation of the recess openings in the direction of the machine axis (left-hand side of the illustration) and a further arrangement according to the present invention in which the slender openings of the recesses are inclined against the machine axis direction x by the angle delta. According to the present invention, angle delta may amount up to 35°, thus ensuring an opposed stagger of the recess openings and the profiles of the respective blade row 3,4 aligned at an angle lambda to the axis x.

FIG. 7*b* shows two arrangements according to the present invention in which, within the framework of the present invention, different length and/or differently positioned recesses 5 are employed along the circumference.

FIG. 7*c* shows two arrangements according to the present invention in which, within the framework of the present invention, a variation of the width of the recess opening in its longitudinal direction is provided.

On fluid flow machines according to the present invention, an as yet unattained degree of space-saving boundary flow influencing is thus obtained which also enables a significant reduction of the constructional and cost investment (less variable stators and intermediate stage bleeding) which would be required for state-of-the-art machines to provide an adequate operating range. This is attainable on various types of fluid flow machines, such as blowers, compressors, pumps and fans. Depending on the degree of utilization of the concept, cost and weight reductions of 10% to 20% are obtainable for the fluid flow machine. This is accompanied by an increase of efficiency which is figured at 0.2% to 0.5%.

LIST OF REFERENCE NUMERALS

1 Casing
2 Shaft
3 Rotor blade
4 Stator blade
5 Recess
6 Machine axis

What is claimed is:

1. A fluid flow machine with a flow path provided by a casing and a rotating shaft, in which rows of rotor blades and stator blades are arranged, comprising:

a plurality of spaced apart recesses disposed circumferentially around at least one of an annulus duct wall of the casing or the shaft opposing blade tips of one of the rows of blades, the recesses and the blade tips being movable relative to one another, wherein a section and a position of each recess are defined as follows:

an upstream end point E of the recess in a flow direction is set at a distance e>0 forward of a forward blade tip point A, a downstream end point F of the recess in the flow direction is set at a distance f behind the forward blade tip point A, with 0.5 L>f>0, where L is a distance between forward blade tip point A and a rearward blade tip point B, a wall of the recess includes a point S which is an intersection between the wall of the recess and a line both passing through point A and orthogonal to a line intersecting points A and B ("line A-B"), a line tangent to the wall of the recess at at least one point on the wall of the recess between the points S and F, is at an angle beta to line A-B, where: 15°≦beta≦70°, two other points C and D are set on a course of the annulus duct wall upstream of the recess, with point C being a distance of 0.75 L to the blade tip point A and point D being a distance of 0.25 L to the blade tip point A, and with line A-B intersecting line C-D at an angle alpha, where: −15°<alpha<30°, with all points A, B, C, D, E, F, and S lying in a meridional plane established by an axial direction x of an axis of the fluid flow machine and a radial direction r, and with all distances being measured parallel to line A-B;

wherein each recess extends along an axis to maintain a straight air flow through the recess.

2. The fluid flow machine of claim 1, wherein: 15°≦beta≦40°.

3. The fluid flow machine of claim 2, wherein: end point E is positioned upstream of point D.

4. The fluid flow machine of claim 3, wherein end point E is positioned in a bladed area of a further blade row disposed upstream of the blades designated by points A and B.

5. The fluid flow machine of claim 4, wherein the wall of the recess has a completely curved shape.

6. The fluid flow machine of claim 4, wherein the wall of the recess includes at least one linearly extending portion.

7. The fluid flow machine of claim 4, wherein the recess is inclined at an inclination angle gamma against a direction of rotation, where: 25°≦gamma≦75°, with respect to the radial direction r.

8. The fluid flow machine of claim 7, wherein one longitudinal edge of the recess is inclined against the machine axis direction by an angle delta, where: delta≦35°.

9. The fluid flow machine of claim 8, wherein at least one recess in its opening section on the annulus duct wall includes a varying width or extension, respectively, in the circumferential direction.

10. The fluid flow machine of claim 9, wherein, in a case of multiple recesses, two circumferentially adjacent recesses have at least one of different relative positions and lengths).

11. The fluid flow machine of claim 1, wherein: end point E is positioned upstream of point D.

12. The fluid flow machine of claim 1, wherein end point E is positioned in a bladed area of a further blade row disposed upstream of the blades designated by points A and B.

13. The fluid flow machine of claim 1, wherein the wall of the recess has a completely curved shape.

14. The fluid flow machine of claim 1, wherein the wall of the recess includes at least one linearly extending portion.

15. The fluid flow machine of claim 1, wherein the recess is inclined at an inclination angle gamma against a direction of rotation, where: 25°≦gamma≦75°, with respect to the radial direction r.

16. The fluid flow machine of claim 1, wherein one longitudinal edge of the recess is inclined against the machine axis direction by an angle delta, where: delta 35°.

17. The fluid flow machine of claim 1, wherein at least one recess in its opening section on the annulus duct wall includes a varying width or extension, respectively, in the circumferential direction.

18. The fluid flow machine of claim 1, wherein, in a case of multiple recesses, two circumferentially adjacent recesses have at least one of different relative positions and lengths.

19. The fluid flow machine of claim 1, wherein each recess extends along a plane including the axis, with the plane extending from a radially inward to a radially outward portion of the recess and from a downstream portion to an upstream portion of the recess.

* * * * *